US012653303B2

(12) United States Patent
Hirstein et al.

(10) Patent No.: US 12,653,303 B2
(45) Date of Patent: Jun. 16, 2026

(54) TRAY WITH UNDER-MATTRESS MOUNT

(71) Applicant: CKnapp Sales, Inc., Goodfield, IL (US)

(72) Inventors: Cody Ryan Hirstein, Eureka, IL (US); Brandon Kaeb, Gridley, IL (US)

(73) Assignee: CKnapp Sales, Inc., Goodfield, IL (US)

( * ) Notice: Subject to any disclaimer, the term of this patent is extended or adjusted under 35 U.S.C. 154(b) by 25 days.

(21) Appl. No.: 18/629,924

(22) Filed: Apr. 8, 2024

(65) Prior Publication Data

US 2025/0311845 A1 Oct. 9, 2025

(51) Int. Cl.
*A47B 23/02* (2006.01)

(52) U.S. Cl.
CPC ..... *A47B 23/025* (2013.01)

(58) Field of Classification Search
CPC ..... A47B 23/02; A47B 23/025; A47B 23/00
See application file for complete search history.

(56) References Cited

U.S. PATENT DOCUMENTS

| | | | | |
|---|---|---|---|---|
| 1,894,991 | A * | 1/1933 | Hayes | A47B 23/02 108/140 |
| 4,687,167 | A * | 8/1987 | Skalka | A47B 21/0314 108/103 |
| 5,671,900 | A * | 9/1997 | Cutler | B25H 1/00 248/448 |
| D473,065 | S | 4/2003 | Wilson et al. | |
| 9,924,805 | B2 | 3/2018 | Cass | |
| 10,034,806 | B1 | 7/2018 | Greenhalgh, Sr. | |
| 10,765,223 | B2 | 9/2020 | Marino | |
| D962,676 | S | 9/2022 | Eng | |
| 2004/0261175 | A1 | 12/2004 | May | |
| 2006/0085917 | A1 * | 4/2006 | Miller | A61G 5/14 5/507.1 |
| 2011/0191957 | A1 | 8/2011 | Hornbach et al. | |
| 2015/0296977 | A1 | 10/2015 | Calderone | |
| 2016/0058177 | A1 * | 3/2016 | Calderone | A47B 3/002 5/507.1 |
| 2018/0339660 | A1 * | 11/2018 | Tabor | A45C 5/02 |
| 2021/0369523 | A1 * | 12/2021 | Kousik | A61G 7/0518 |

OTHER PUBLICATIONS

BedShelfie Bedside Shelf for Bunk Bed & Top Bunk, College Dorm Room Essentials, Clip on Nightstand, Bed Side Table Tray Organizer—Cable Catch, Black; entire webpage; www.amazon.com/BedShelfie-CableCatch-Original-Essentials-Business/dp/B09XLWZ1T1; retrieved Apr. 8, 2024.

BedShelfie; BedShelfie Plus—Bamboo Bedside Shelf / Space-Saving Floating Nightstand (Plus Size in Black); entire webpage; www.bedshelfie.com/products/black-plus; retrieved Apr. 8, 2024.

(Continued)

*Primary Examiner* — Sarah B McPartlin
(74) *Attorney, Agent, or Firm* — Lund IP, PLLC

(57) ABSTRACT

A tray assembly for use with a bed includes a planar support configured to extend under a mattress of the bed, an upright post connected to the planar support, an arm connected to the upright post, and a worksurface platform mounted to an end of the arm opposite the upright post, wherein the arm provides an adjustable spacing between the upright post and the worksurface platform.

23 Claims, 7 Drawing Sheets

(56) References Cited

OTHER PUBLICATIONS

Sidekiix; Height Adjustable Under Mattress 17 inch Bedside Shelf, Works with Lofts and Beds Without Frames, Heavy Duty Storage Tray, Fits Laptops, Books, and Drinks, Nightstand Alternative, Black; entire webpage; www.amazon.com/Adjustable-Mattress-Bedside-Nightstand-Alternative/dp/BOCJ5PVSPK; retrieved Apr. 8, 2024.

Sleeper Shelf Bedside Phone Stand & Cable Organizer Lined with Silicone for Anti-Slip/Small Space Nightstand, Tray; entire webpage; www.amazon.com/Sleeper-Shelf-Organizer-Anti-Slip-Nightstand/dp/BOCGVXQM3K; retrieved Apr. 8, 2024.

Stander, Inc.; 2050 Assist-A-Tray V 2.1, Safety Warnings & Assembly Instructions; entire document; Jun. 8, 2021; Logan, Utah.

Stander, Inc.; 7630 Signature Life Premium Tray V 1.1, Safety Warnings & Assembly Instructions; entire document; circa 2021; Logan, Utah.

Vaunn Adjustable Overbed Bedside Table With Wheels (Hospital and Home Use), Walnut Brown; entire webpage; www.amazon.com/Vaunn-Medical-Adjustable-Overbed-Hospital/dp/B00QMNTMXA; retrieved Apr. 8, 2024.

Vaunn Medical New Adjustable Bed Assist Rail Handle (Passed ASTM F3186-17 Safety Standard) and Hand Guard, Bedside Safety and Tool-Free Assembly; entire webpage; www.amazon.com/Medical-Adjustable-Stability-Tool-Free-Assembly/dp/B06ZZVW94J; retrieved Apr. 8, 2024.

Vivo; Mount-KB35A Black Pneumatic Wall Mounted Keyboard Tray, Instruction Manual, REV2.1; entire manual; Mar. 29, 2024, Goodfield, Illinois.

Vivo; Mount-KB35B Black Pneumatic Wall Mounted Keyboard Tray, Instruction Manual, REV1.1; entire manual; Aug. 21, 2023, Goodfield, Illinois.

Vivo; Stanf-V002FGL Monitor and Laptop Desk Stand, Instruction Manual, REV1; entire manual; May 31, 2022, Goodfield, Illinois.

Wishacc Bamboo Book Stand Height Adjustable with Clamp, Table Side Cookbook Rest—Desktop Reading Mount Holder with Sturdy Page Clips 11 x 8.1 inch; entire webpage; www.amazon.com/Bamboo-Height-Adjustable-wishacc-Cookbook/dp/B09LS55ZLQ; retrieved Apr. 8, 2024.

Yumkfoi Wooden Bed Shelf with Height Adjustable, Multipurpose Bunk Bed Shelf Table Tray, Bedside Shelf for Top Bunk Dorm Room, Clamp on Nightstand Caddy Organizer for Bedroom College Dorm Essentials; entire webpage; www.amazon.com/Yumkfoi-Adjustable-Multipurpose-Nightstand-Essentials/dp/BOCNH2TXKV; retrieved Apr. 8, 2024.

* cited by examiner

TRAY WITH UNDER-MATTRESS MOUNT

TECHNICAL FIELD

This disclosure relates to bedside trays.

BRIEF SUMMARY

The present disclosure relates to a tray assembly for use with a bed. For example, a tray assembly includes a planar support configured to extend under a mattress of the bed, an upright post connected to the planar support, an arm connected to the upright post, and a worksurface platform mounted to an end of the arm opposite the upright post. The arm provides an adjustable spacing between the upright post and the worksurface platform. Tray assemblies disclosed herein can be used for various purposes, such as holding a laptop or tablet, providing a surface for eating or writing, or assisting a user in getting out of bed.

In one example, a tray assembly for use with a bed includes a planar support configured to extend under a mattress of the bed, an upright post connected to the planar support, an arm connected to the upright post, and a worksurface platform mounted to an end of the arm opposite the upright post, wherein the arm provides an adjustable spacing between the upright post and the worksurface platform.

DETAILED DESCRIPTION

Figure 1A:
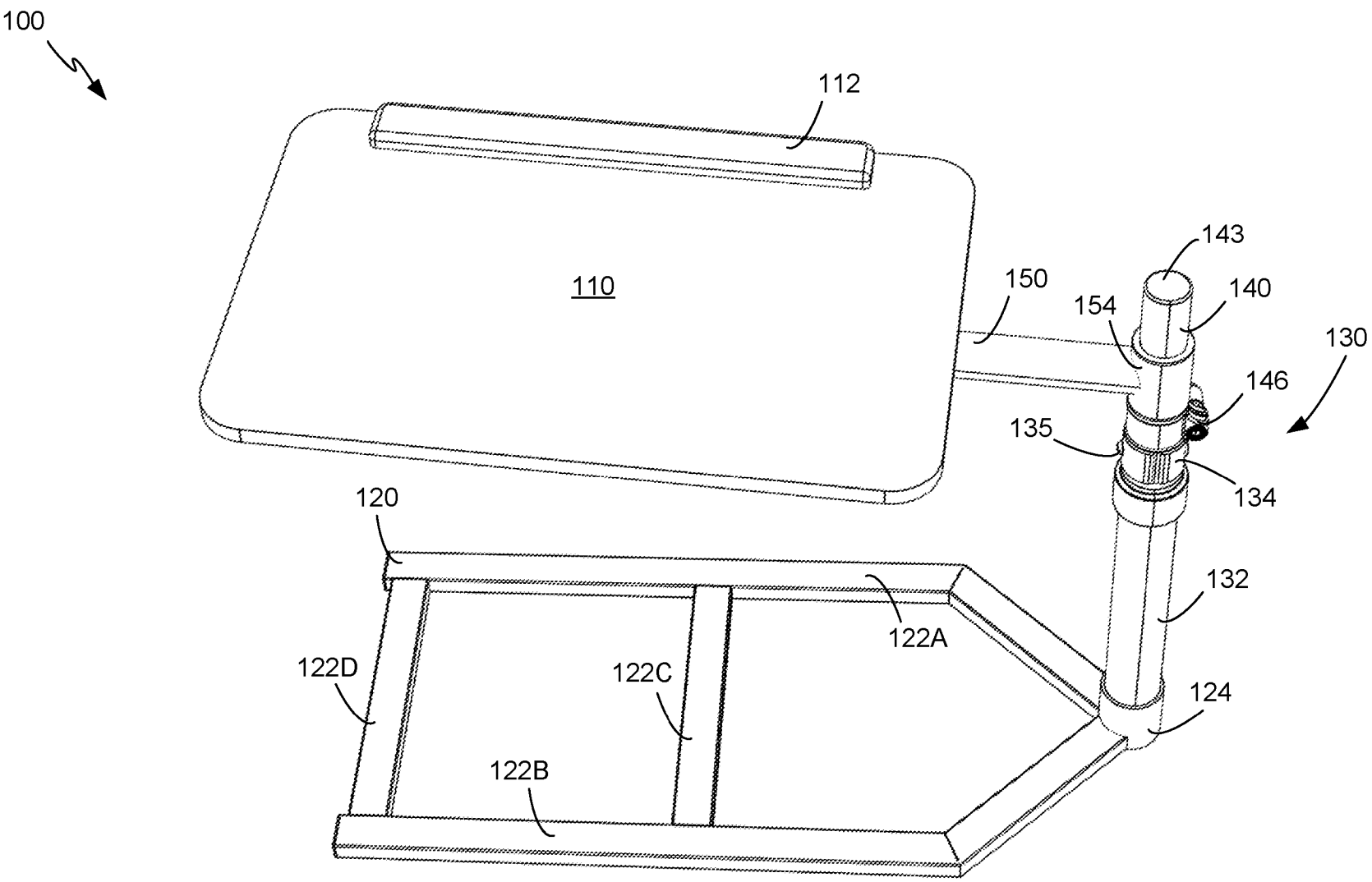
FIG. 1A illustrates an isometric view of a tray assembly with a worksurface platform, an arm, and an upright post connected to a planar support.
Figure 1B:
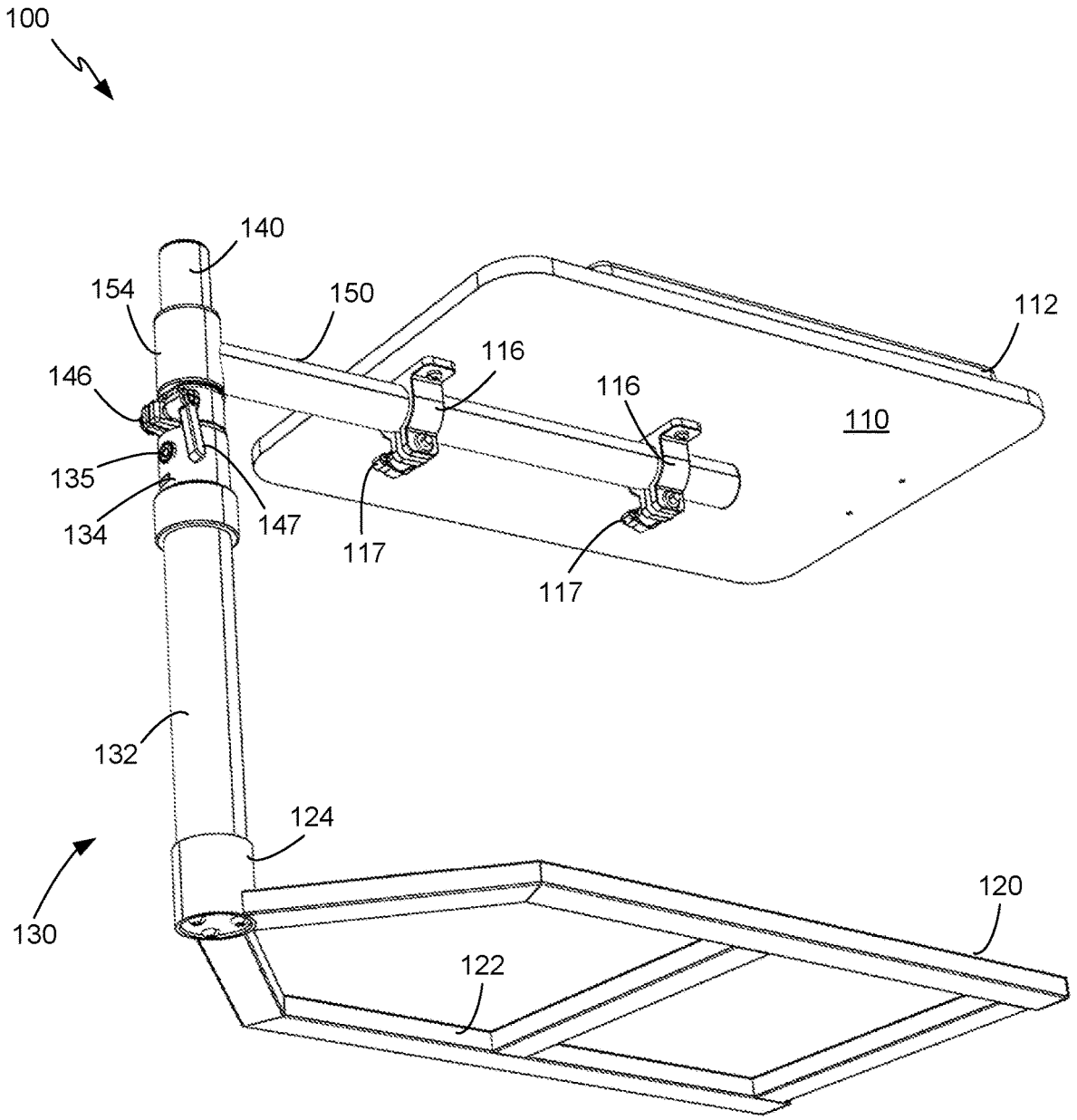
FIG. 1B provides a bottom perspective view of the tray assembly, showcasing the bar clamps on the underside of the worksurface platform.
Figure 1C:
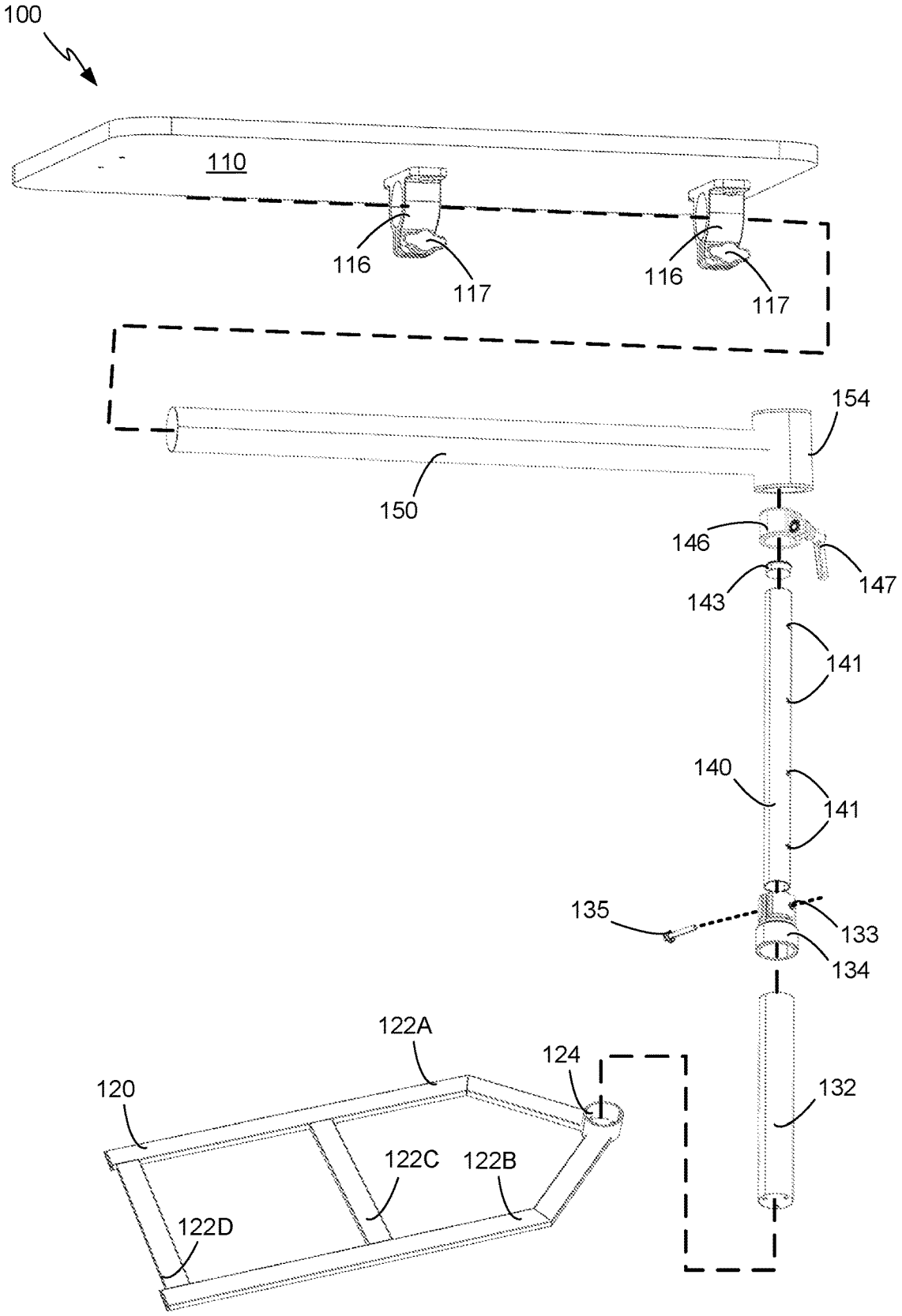
FIG. 1C depicts an exploded view of the tray assembly, highlighting the telescoping tubular design of the upright post and the locking collar.

FIGS. 1A-1C illustrate a tray assembly 100 for use with a bed. FIG. 1A is an isometric view of tray assembly 100. The tray assembly 100 includes a worksurface platform 110, which provides a worksurface that can be used for various purposes, such as holding a laptop or tablet, providing a surface for eating or writing. The worksurface platform 110 may be supported by an arm 150 that connects to an upright post 130. The upright post 130 may extend into a post socket 124 of a planar support 120. The planar support 120 is configured to extend under a mattress. In some aspects, the planar support 120 is designed with a low-profile to mitigate the impact on mattress comfort. The planar support 120 may be designed to fit a range of mattress sizes. In some cases, the planar support 120 includes a mechanism for securing the tray assembly 100 to the bed frame to prevent movement.

The upright post 130 includes multiple nesting poles and one or more friction collars to set an adjustable height. In particular, the upright post 130 includes an outer tube 132 with a locking collar 134 secured by a locking collar bolt 135, and an inner tube 140 capped by an end cap 143. The upright post 130 may be equipped with a locking mechanism to prevent unintended height adjustments. Further details regarding height adjustment and upright post are included in the description of FIG. 1C.

The arm 150 is pivotably connected to the upright post 130, allowing the worksurface platform 110 to be positioned along arm 150 opposite the upright post 130 at various angles relative to the upright post 130. In some cases, the arm 150 is rotatable around the upright post 130. The arm 150 may be attached to the upright post 130 via an arm collar 154 which tightly fits over the upright post 130, but allows for pivoting of the arm by way of a friction fit. In some examples, the arm collar 154 includes an internal sleeve to facilitate the rotation motion of the arm relative to the upright post 130.

The height of the arm 150 may be set by the position of a collar clamp 146 mounted to the post 130 immediately below the arm collar 154. A clamp handle 147 allows a user to selectively move and fix the height of the arm 150 on the upright post 130.

The arm 150 may provide an adjustable spacing between the upright post 130 and the worksurface platform 110. The worksurface platform 110 may be mounted at a selectable position along the arm 150 with a compression mount that includes a locking mechanism to secure the selected spacing between the upright post 130 and the worksurface platform 110. The worksurface platform 110 may be adjustable in tilt for ergonomic positioning. The worksurface platform 110 may include a non-slip surface to prevent items from sliding off. In some cases, the worksurface platform 110 includes a built-in mouse pad area. The worksurface platform 110 may include a thermal insulation layer to maintain the temperature of items placed on it. The worksurface platform 110 may be designed to accommodate a docking station for electronic devices. The worksurface platform 110 may have a heat-resistant surface to safely hold heated devices or containers. The worksurface platform 110 may also include an attached wrist pad 112. The wrist pad 112 may provide additional comfort for a user when using the worksurface platform 110.

The upright post 130 is coupled to the planar support 120, which functions to counteract the forces on worksurface platform 110 to maintain the upright post 130 in an upright position. For example, the upright post 130 may extend into a post socket 124 of a planar support 120. The planar support 120, designed to extend under a mattress, includes a right-side frame element 122A, a left-side frame element 122B, a middle crossbeam frame element 122C, and an end crossbeam frame element 122D arranged in a planar configuration relative to each other. These elements may be formed from tubes, plates or other base materials. This allows positioning the planar support under a mattress with limited interruption to a person's sleep.

In some examples, one or more gusset may be used to support the connection between the planar support 120 and the upright post 130. For example, the gussets may be gusset plates attached, such as by weld connection, to post socket 124 and each of the frame elements 122A, 122B. In other examples, the upright post 130 may be fixed to the planar support 120 and one or more gussets may extend between the upright post 130 and the planar support 120, such as gusset plates extending between outer tube 132 and each of the frame elements 122A, 122B.

As referred to herein, a planar support for a tray assembly, such as planar support 120 includes one or more elements arranged in a common plane to facilitate insertion under a mattress with limited disruption to a user. The elements on either side of the planar support, e.g., right-side frame element 122A and left-side frame element 122B should be of an approximately consistent thickness, such as one inch or less, such as between one inch to 1/16 of an inch. The planar support is configured to extend under the mattress with a length at least 12 inches such as between 12 to 36 inches, such as between 16 to 30 inches. This length is measured from post 120 to the distal ends of right-side frame element 122A and left-side frame element 122B. The planar support elements also fan out from the post to provide side-to-side stability for the tray assembly in the dimension parallel to the edge of the mattress. This width is measured from the outer edges of right-side frame element 122A and left-side frame element 122B. As examples the planar support may fan out a width of at least 6 inches such as between 6 to 24 inches, such as between 6 to 18 inches, in a direction perpendicular to the length of the planar support as measured from the post.

To enhance the stability of the tray assembly 100 and prevent slippage between the mattress and the planar support 120, a slip-resistant coating may be applied to the contact surfaces of the planar support 120. This coating may be made of a high-friction material that grips the underside of the mattress, reducing the likelihood of movement and providing added security for the tray assembly 100. Alternatively, or in addition to a slip-resistant coating, a strap, such as strap 260 (FIG. 2A) may be used to secure the planar support 120 relative to a bedframe.

The tray assembly 100 may be constructed from a variety of materials, including but not limited to metal, plastic, and composite materials. The size and dimensions of the tray assembly 100 may also vary depending on the specific application or user requirements. For instance, the tray assembly 100 may be designed to fit a range of mattress sizes. The fixation mechanisms, such as the bar clamps 116 and thumb screws 117, may also vary in design and operation. For example, the bar clamps 116 may be replaced with other types of clamps or fasteners, and the thumb screws 117 may be replaced with other types of screws or tightening devices.

Referring now to FIG. 1B, a bottom perspective view of the tray assembly 100 is depicted. In this view, bar clamps 116 are visible on the underside of the worksurface platform 110. The bar clamps 116 may be used to secure the worksurface platform 110 to the arm 150. In some cases, the position and angle of the worksurface platform 110 relative to the arm 150 may be fixed by tightening the bar clamps 116 with thumb screws 117. This configuration may allow for the worksurface platform 110 to be positioned at a selectable position along the arm 150.

Referring now to FIG. 1C, an exploded view of the tray assembly 100 is depicted. The upright post 130 may be a telescoping tubular design including an outer tube 132 and an inner tube 140. The height of the inner tube 140 may be set relative to the outer tube 132 with a locking collar 134. The locking collar 134 includes a hole 133. A locking collar bolt 135 may extend through the hole 133 and one of the holes 141 in the inner tube 140 to fix the position of the locking collar 134 on the inner tube 140. The locking collar 134 itself may rest on the open end of the outer tube 132 such that the height of the inner tube 140 is likewise fixed by the locking collar 134.

In alternative variations, a modified tray assembly 100 may include an upright post configured with an advanced height adjustment mechanism, such as a gas spring or an electric motor. This feature facilitates effortless and precise height modification of the upright post 130, allowing users to easily adjust the tray assembly 100 to their preferred ergonomic position. The gas spring or motor may be integrated within the upright post 130, which may consist of an outer tube 132 and an inner tube 140 that telescopes relative to one another. The inclusion of a gas spring or motor provides a smooth and controlled movement, enhancing the user experience by enabling a quick and fluid transition between different height settings The gas spring mechanism may operate on the principle of pneumatic pressure, which can be activated by a lever or a button located on the upright post 130, arm 150 or the worksurface platform 110. When engaged, the gas spring may allow the inner tube 140 to extend or retract with respect to the outer tube 132, thereby adjusting the height of the worksurface platform 110. This system may be designed to lock at various predetermined heights, providing a range of positions to accommodate different use cases, such as working, reading, or using electronic devices in bed.

Alternatively, the upright post 130 may be equipped with an electric motor that drives the telescopic movement of the inner tube 140. The motorized height adjustment can be powered by a rechargeable battery or a power cord, and may be controlled by a switch, a remote control, or even a smartphone app. This option may offer users the convenience of adjusting the height of the tray assembly 100 without manual effort, which can be particularly beneficial for individuals with limited mobility or strength.

Figure 2A:
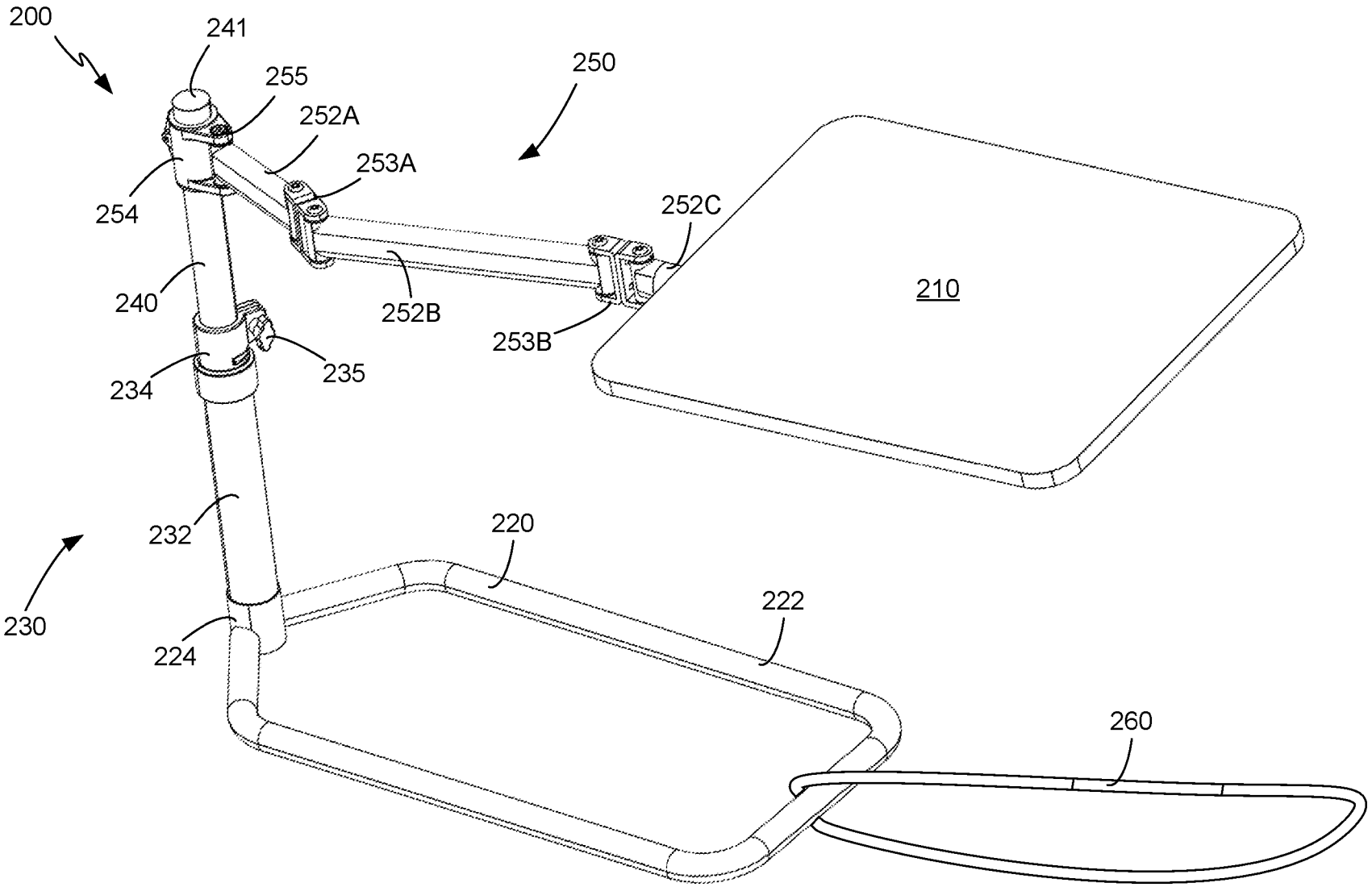
FIG. 2A presents an isometric view of a different tray assembly, featuring a three-segment arm and a looped tubular frame for the planar support.

Referring now to FIG. 2A, an isometric view of another tray assembly 200 is depicted. Tray assembly 200 is substantially similar to tray assembly 100 except that tray assembly 200 includes a multi-segment arm 250. The details of tray assembly 200 may be interchanged with details of tray assembly 100.

The tray assembly 200 may include a worksurface platform 210, which is substantially similar to the worksurface platform 110. The worksurface platform 210 may be supported by an arm 250 that connects to an upright post 230. The upright post 230 may extend into a post socket 224 of a planar support 220. The planar support 220 may be configured to extend under a mattress. In some aspects, the planar support 220 is designed with a low-profile to mitigate the impact on mattress comfort. The planar support 220 may be designed to fit a range of mattress sizes. In some cases, the planar support 220 includes a mechanism for securing the tray assembly 200 to the bed frame to prevent movement.

The upright post 230 may comprise an outer tube 232 with a locking collar 234 secured by a locking collar bolt 235, and an inner tube 240 capped by an end cap 241. The upright post 230 may include multiple nesting poles and one or more friction collars to set an adjustable height. The upright post 230 may be equipped with a locking mechanism to prevent unintended height adjustments. The locking mechanism may include a locking collar 234 that can be engaged or disengaged by twisting. The upright post 230 may include a telescopic locking mechanism with incremental height settings. In some cases, the upright post 230 may be detachable from the planar support 220.

The arm 250 may be attached to the upright post 230 via an arm collar 254 which tightly fits over the upright post 230, but allows for pivoting of the arm 250 by way of a hinge 255. In some examples, the arm collar 254 includes a collar clamp to fix the arm collar 254 relative to the upright post 230. Arm 250 is a three-segment arm, each segment separated by a horizontal pivot. Arm collar hinge 255 allows first arm segment 252A to pivot horizontally relative the arm collar 254. First arm segment hinge 253A allows second arm segment 252B to pivot horizontally relative the first arm segment 252A. Second arm segment hinge 253B allows third arm segment 252C to pivot horizontally relative the second arm segment 252B. Third arm segment 252C includes an optional end cap 251 opposite the second arm segment hinge 253B.

The worksurface platform 210 may be mounted at a selectable position along the arm 250 with a compression mount that includes a locking mechanism to secure the selected spacing between the upright post 230 and the worksurface platform 210. The worksurface platform 210 may be adjustable in tilt for ergonomic positioning. The worksurface platform 210 may include a non-slip surface to prevent items from sliding off. In some cases, the worksurface platform 210 includes a built-in mouse pad area. The worksurface platform 210 may include a thermal insulation layer to maintain the temperature of items placed on it. The worksurface platform 210 may be designed to accommodate a docking station for electronic devices. The worksurface platform 210 may have a heat-resistant surface to safely hold heated devices or containers.

The planar support 220, designed to extend under a mattress, may consist of a looped tubular frame 222 arranged in a planar configuration. This allows positioning the planar support 220 under a mattress with limited interruption to a person's sleep. The looped tubular frame 222 may have a reduced cost compared to frame 122 as it may be formed from a unitary component such as a bent tube. Strap 260 includes an adjustable length, such as Velcro or buckle to securely connect the planar support 220 to a bed frame.

The tray assembly 200 may be constructed from a variety of materials, including but not limited to metal, plastic, and composite materials. The size and dimensions of the tray assembly 200 may also vary depending on the specific application or user requirements. For instance, the tray assembly 200 may be designed to fit a range of mattress sizes. The fixation mechanisms, such as the bar clamps 216 and thumb screws 217, may also vary in design and operation. For example, the bar clamps 216 may be replaced with other types of clamps or fasteners, and the thumb screws 217 may be replaced with other types of screws or tightening devices.

Figure 2B:
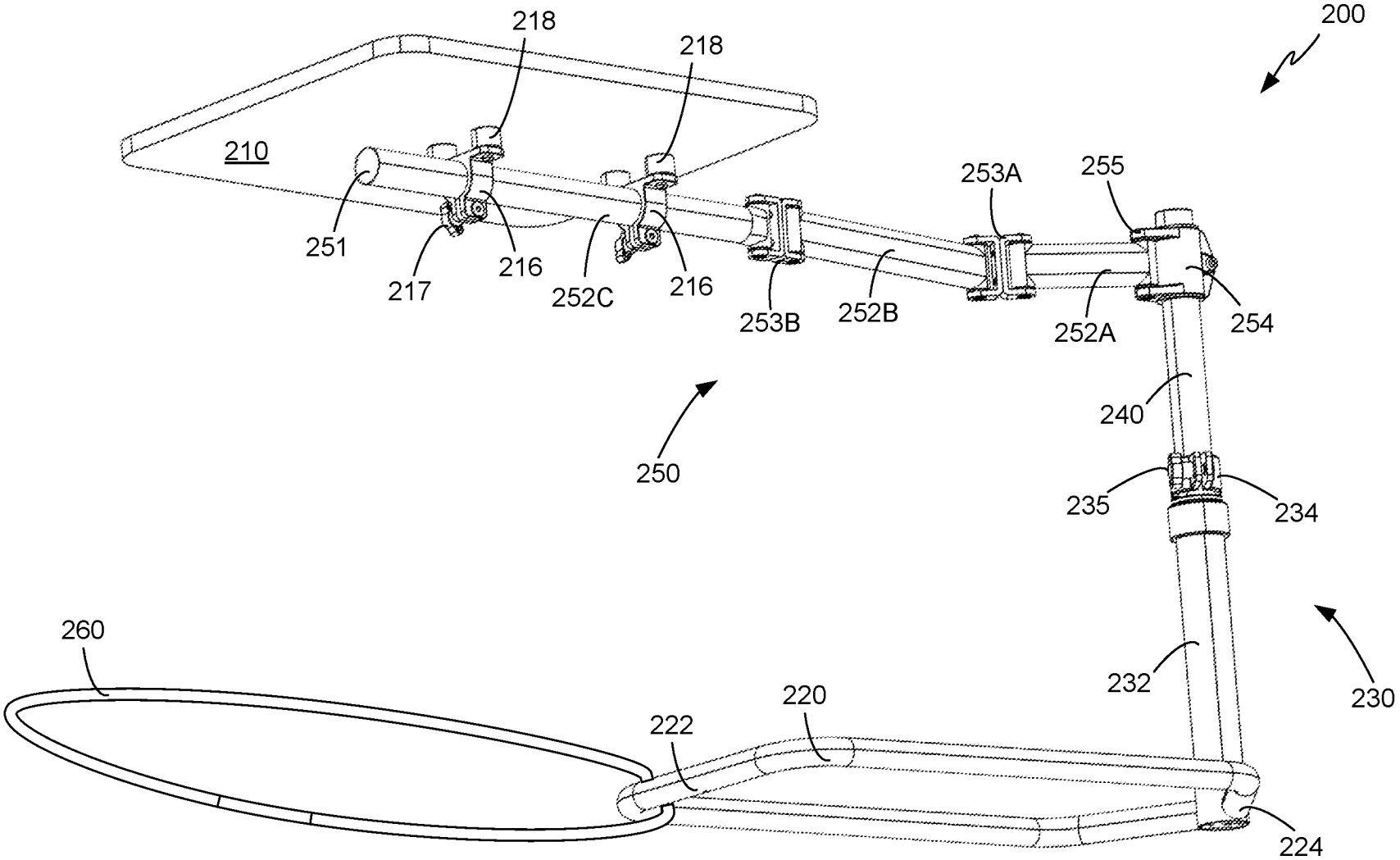
FIG. 2B offers a bottom perspective view of the tray assembly, emphasizing the bar clamps on the underside of the worksurface platform.

Referring now to FIG. 2B, a bottom perspective view of the tray assembly 200 is shown. In this view, bar clamps 216 are visible on the underside of the worksurface platform 210. Tray assembly also includes optional rubber grommets 218 between the underside of the worksurface platform 210 and the bar clamps 216. Rubber grommets 218 may provide vibration damping and/or mitigate the risk of overtightening screws securing bar clamps 216 to the platform 210. The bar clamps 216 may be used to secure the worksurface platform 210 to the arm 250. In some cases, the position and angle of the worksurface platform 210 relative to the arm 250 may be fixed by tightening the bar clamps 216 with thumb screws 217. This configuration may allow for the worksurface platform 210 to be positioned at a selectable position along the arm segment 252C.

In a further variation to arms 150, 250, other designs may include may incorporate a pneumatic height adjustment mechanism that enables the user to modify the height of the worksurface platform 110. This mechanism may function by employing a system of pressurized air. The pneumatic height adjustment mechanism may be integrated into the arm 150 or into any segment of arm 250. The user may adjust the height by activating a lever or button, which releases or contains the pressurized air within the mechanism, thereby raising or lowering the arm 150 to the desired position.

The pneumatic height adjustment mechanism may include a cylinder housed within the arm 150, which contains compressed air that exerts an upward force when released. This force may counterbalance the weight of the worksurface platform 110 and any items placed upon it, facilitating a smooth and controlled adjustment. The user may engage the lever or button to release the air pressure, allowing the arm 150 to move freely. Once the worksurface platform 110 reaches the preferred height, the user may release the lever or button, causing the mechanism to lock and maintain the selected height. This feature may be particularly advantageous for users who require frequent adjustments to the height of the worksurface platform 110, such as in a healthcare setting or for individuals with varying ergonomic requirements.

Figure 3A:
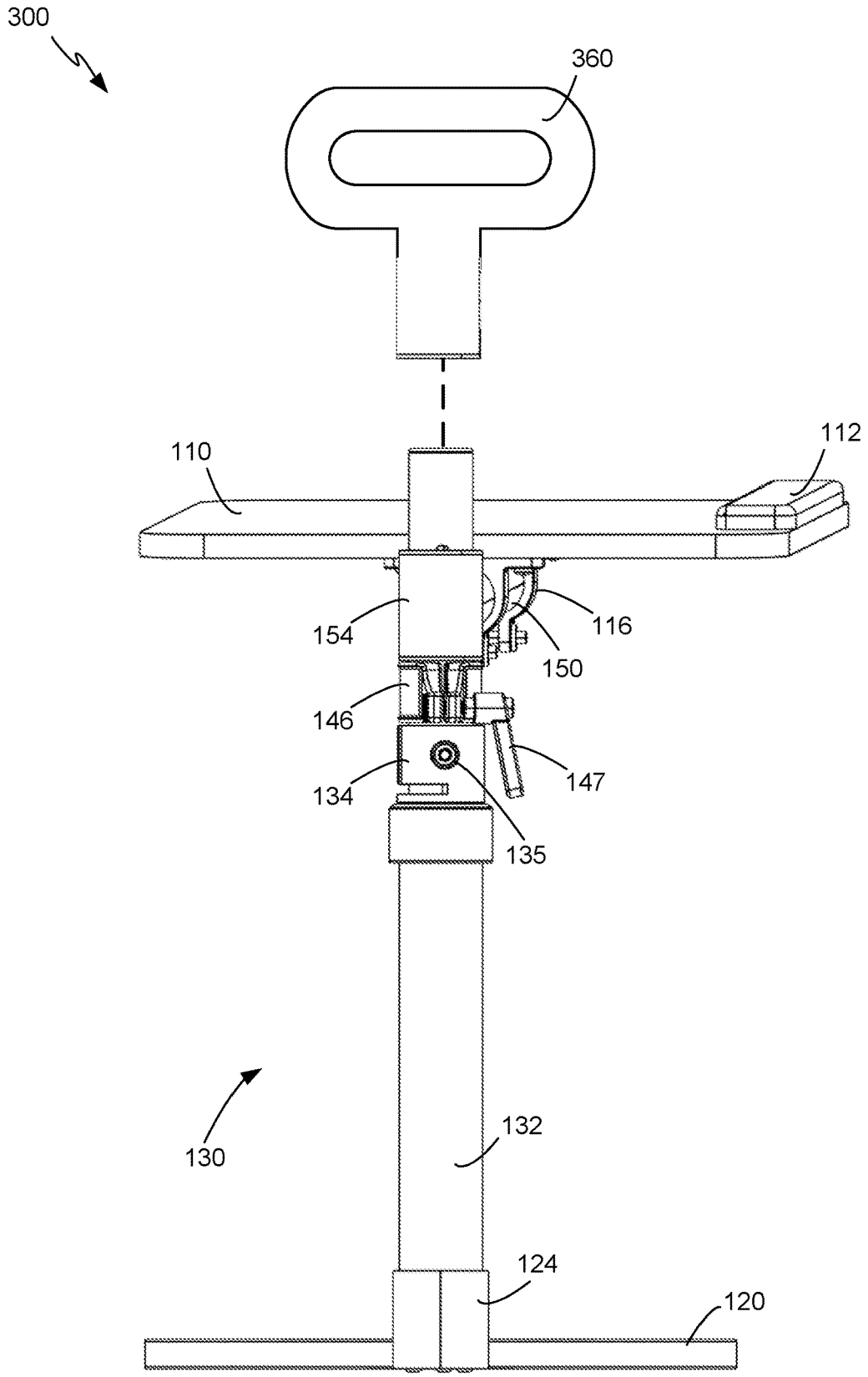
FIG. 3A illustrates a tray assembly with the addition of a looped handle on the upright post.

FIG. 3A is an isometric view of the tray assembly 300. Tray assembly 300 is the same as tray assembly 100 with the addition of a looped handle 360. The looped handle 360 may be attached to the top of the upright post 130 to assist a user in getting out of bed. The looped handle 360 may include a grip 362 and a socket 364. The grip 362 may provide a comfortable and secure hold for the user, while the socket 364 may facilitate the attachment of the looped handle 360 to the upright post 130. In some cases, the looped handle 360 may be detachable from the upright post 130 for case of transport or storage. In other cases, the looped handle 360 may be fixedly attached to the upright post 130.

The looped handle 360 is just one example of a handle that may be used with the tray assembly 100. In other aspects, different types of handles may be used, such as a T-handle, a bent cane handle, or a ball handle. Each of these handles may be designed to provide a comfortable and secure grip for the user and may be attached to the top of the upright post 130 in a similar manner as the looped handle 360. The specific design and configuration of the handle may vary depending on the specific application or user requirements.

The functional aspect of the handles, such as the looped handle 360, attached to the top of the upright post 130, may assist a user in getting out of bed. The handles may be strategically positioned and ergonomically designed to provide a sturdy and comfortable grip, facilitating the user's movement as they sit up or stand. The grip 362 of the looped handle 360, for example, may be shaped to fit the natural contours of the hand, while the socket 364 allows for secure attachment to the upright post 130. These handles may be detachable or permanently affixed, and they may be constructed from materials that offer both strength and comfort to the user.

Figure 3B:
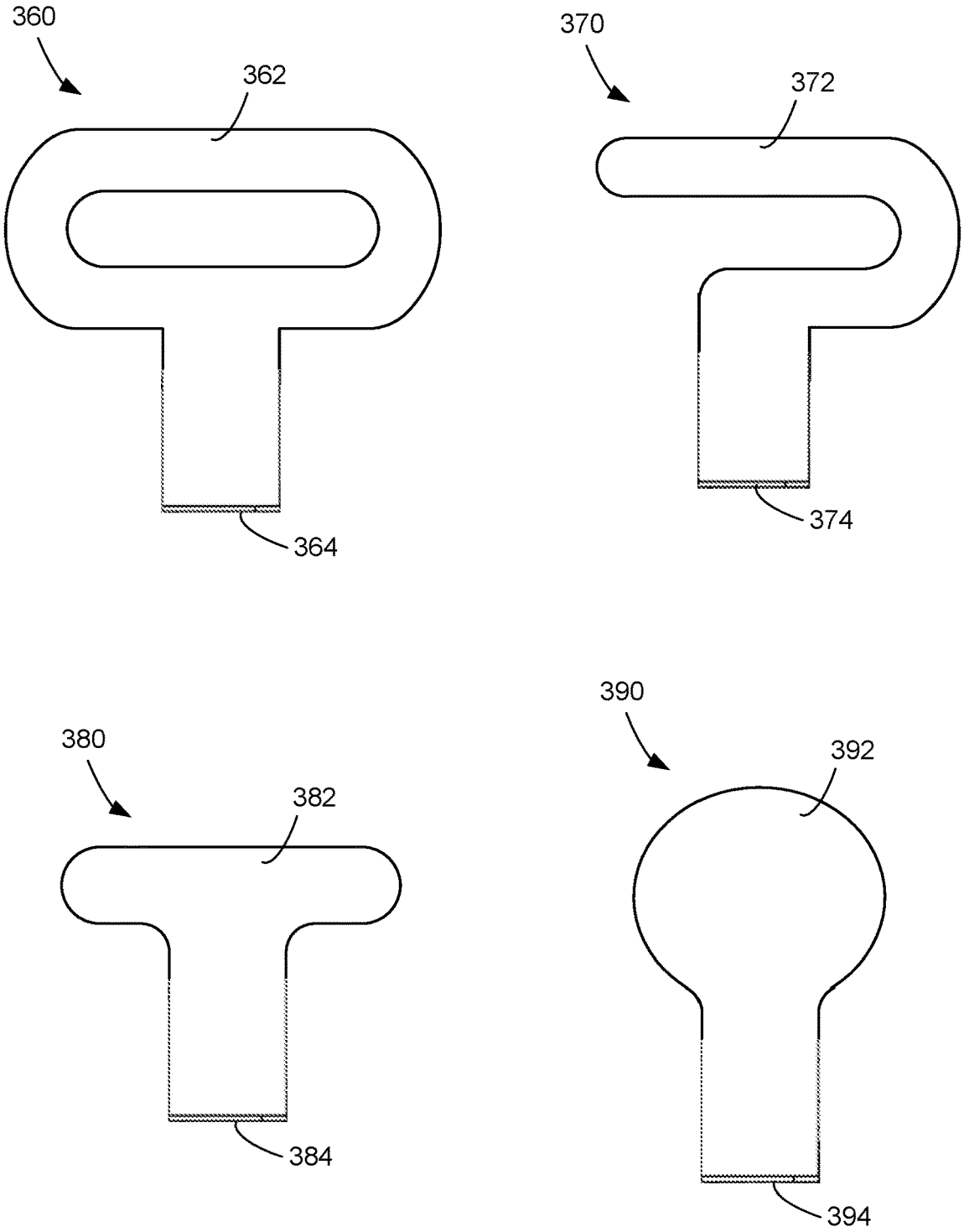
FIG. 3B showcases four separate handle designs that can be used on the upright post of a tray assembly.

Referring now to FIG. 3B, four separate handles that may be used on an upright post of a tray assembly are illustrated. These handles may be selected from a group consisting of a T-handle 380, a bent cane handle 370, a looped handle 360, and a ball handle 390. Each handle may include a grip and a socket. The grip may provide a comfortable and secure hold for the user, while the socket may facilitate the attachment of the handle to the upright post of the tray assembly.

In some aspects, the looped handle 360, as shown in FIG. 3A, includes a grip 362 and a socket 364. The looped handle 360 may provide a comfortable grip for the user and may be easy to grasp from multiple angles. The bent cane handle 370 may include a grip 372 and a socket 374. The bent cane handle 370 may provide a familiar grip for the user, similar to a walking cane. The T-handle 380 may include a grip 382 and a socket 384. The T-handle 380 may provide a secure grip for the user and may be easy to grasp from multiple angles. The ball handle 390 may include a grip 392 and a socket 394. The ball handle 390 may provide a comfortable and ergonomic grip for the user.

In some cases, the handles may be constructed from a variety of materials, including but not limited to metal, plastic, and composite materials. The size and dimensions of the handles may also vary depending on the specific application or user requirements. For instance, the handles may be designed to fit a range of hand sizes. The fixation mechanisms, such as the sockets, may also vary in design and operation. For example, the sockets may be replaced with other types of connectors or fasteners. In some aspects, the handles may be detachable from the upright post for ease of transport or storage. In other cases, the handles may be permanently attached to the upright post.

The specific techniques for tray assemblies, including techniques described with respect to tray assemblies 100, 200, 300, are merely illustrative of the general inventive concepts included in this disclosure as defined by the following claims.

What is claimed is:

1. A tray assembly for use with a bed, comprising:

a planar support configured to extend under a mattress of the bed;

an upright post connected to the planar support;

an arm connected to the upright post and configured to extend laterally over the planar support; and a worksurface platform mounted to an end of the arm opposite the upright post, wherein the worksurface platform is selectively tiltable about the arm while the arm remains in a lateral position over the planar support, and wherein the arm provides an adjustable spacing between the upright post and the worksurface platform, and wherein the worksurface platform is mounted at a selectable position along the arm with a compression mount to secure a selected spacing between the upright post and the worksurface platform and a selected tilt angle for the worksurface platform.

2. The tray assembly of claim 1, wherein the upright post includes multiple nesting poles and one or more friction collars to set an adjustable height.

3. The tray assembly of claim 1, wherein the arm is a multi-segment arm including horizontal pivots between each segment.

4. The tray assembly of claim 3, wherein the multi-segment arm comprises three segments.

5. The tray assembly of claim 1, wherein the planar support includes a looped tubular frame.

6. The tray assembly of claim 1, wherein the worksurface platform is configured to hold a laptop or tablet.

7. The tray assembly of claim 1, wherein the arm is pivotably connected to the upright post, allowing the worksurface platform to be positioned at various angles relative to the upright post, with the arm remaining in a lateral orientation relative to the upright post.

8. The tray assembly of claim 7, wherein the arm is rotatable around the upright post while remaining in the lateral orientation relative to the upright post.

9. The tray assembly of claim 7, wherein the arm provides an adjustable spacing between the upright post and the worksurface platform.

10. The tray assembly of claim 7, wherein the arm is a multi-segment arm including horizontal pivots between each segment.

11. The tray assembly of claim 1, wherein the compression mount includes a locking mechanism to secure the selected spacing between the upright post and the worksurface platform and the selected tilt angle for the worksurface platform.

12. The tray assembly of claim 1, wherein the upright post is equipped with a locking mechanism to prevent unintended height adjustments.

13. The tray assembly of claim 12, wherein the locking mechanism includes a locking collar that can be engaged or disengaged by twisting.

14. The tray assembly of claim 1, wherein the upright post includes a telescopic locking mechanism with incremental height settings.

15. The tray assembly of claim 1, wherein the worksurface platform is adjustable in tilt for ergonomic positioning.

16. The tray assembly of claim 1, wherein the planar support includes a strap to secure the planar support to a bed frame.

17. The tray assembly of claim 1, wherein the planar support includes a slip-resistant coating to enhance grip with the mattress.

18. The tray assembly of claim 1, wherein the planar support is designed with a low-profile to mitigate any impact on mattress comfort.

19. The tray assembly of claim 1, wherein the worksurface platform includes a non-slip surface to prevent items from sliding off.

20. The tray assembly of claim 1, further comprising a handle attached to a top of the upright post to assist a user in getting out of bed.

21. The tray assembly of claim 20, wherein the handle is selected from a group consisting of:

a T-handle;

a bent cane handle;

a looped handle; and a ball handle.

22. The tray assembly of claim 1, wherein the upright post is detachable from the planar support.

23. The tray assembly of claim 1, further comprising a handle attached to a top of the upright post to assist a user in getting out of bed.

* * * * *